US007682193B2

(12) United States Patent
Stoner

(10) Patent No.: US 7,682,193 B2
(45) Date of Patent: Mar. 23, 2010

(54) RETENTION MEMBER

(75) Inventor: Stuart C. Stoner, Lewisberry, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/928,894

(22) Filed: Oct. 30, 2007

(65) Prior Publication Data

US 2009/0111298 A1 Apr. 30, 2009

(51) Int. Cl.
*H01R 9/03* (2006.01)

(52) U.S. Cl. ..... 439/607.07

(58) Field of Classification Search ..... 439/701, 439/608, 79, 941, 885, 607.07
See application file for complete search history.

(56) References Cited

U.S. PATENT DOCUMENTS 4,171,861 A * 10/1979 Hohorst ..... 439/94
5,429,520 A 7/1995 Morlion et al.
5,672,064 A 9/1997 Provencher et al.
5,795,191 A 8/1998 Preputnick et al.
5,860,816 A 1/1999 Provencher et al.
6,132,255 A 10/2000 Verhoeven
6,273,762 B1 * 8/2001 Regnier ..... 439/701
6,299,484 B2 10/2001 Van Woensel
6,361,374 B1 * 3/2002 Lloyd et al. ..... 439/701
6,409,543 B1 6/2002 Astbury, Jr. et al.
6,503,103 B1 1/2003 Cohen et al.
6,506,076 B2 1/2003 Cohen
6,565,388 B1 5/2003 Van Woensel et al.
6,592,381 B2 7/2003 Cohen et al.
6,607,402 B2 8/2003 Cohen et al.
6,712,646 B2 3/2004 Shindo
6,743,057 B2 * 6/2004 Davis et al. ..... 439/701
6,780,059 B1 8/2004 Payne et al.
6,796,849 B2 * 9/2004 Villain ..... 439/700
6,872,085 B1 3/2005 Cohen et al.
6,884,117 B2 4/2005 Korsunsky et al.
7,025,635 B2 * 4/2006 Chang ..... 439/620.07
7,074,086 B2 7/2006 Cohen et al.
7,083,432 B2 * 8/2006 Hull et al. ..... 439/79
7,101,191 B2 9/2006 Benham et al.

(Continued)

OTHER PUBLICATIONS

Teradyne Connection Systems, Inc., Customer Use Drawing No. C-163-5101-500, Rev. 04, Aug. 25, 2005.

(Continued)

*Primary Examiner*—T C Patel
*Assistant Examiner*—Harshad C Patel
(74) *Attorney, Agent, or Firm*—Woodcock & Washburn LLP

(57) ABSTRACT

An electrical connector may include a connector housing, a first leadframe assembly received in the connector housing, a second leadframe assembly received in the connector housing and a retention member. Each leadframe assembly may include a leadframe housing, and a plurality of electrically conductive contacts extending therethrough. Each leadframe housing may include a recess. The retention member may include a first body portion, a first member extending from the first body portion and a second member extending from the first body portion such that a face of the first member opposes a face of the second member. The first member may apply a first force against a first surface of each respective recess and the second member may apply a second force against a second surface of each respective recess.

27 Claims, 8 Drawing Sheets

U.S. PATENT DOCUMENTS

| | | | | |
|---|---|---|---|---|
| 7,172,461 | B2 * | 2/2007 | Davis et al. | 439/608 |
| 7,195,497 | B2 * | 3/2007 | Hull et al. | 439/79 |
| 7,270,574 | B1 | 9/2007 | Ngo | |
| 7,503,804 | B2 | 3/2009 | Minich | |
| 2003/0186594 | A1 * | 10/2003 | Davis et al. | 439/701 |

OTHER PUBLICATIONS

TB-2127 Ventura Application Design, Revision, "General Release", Specification Revision Status - B. Hunsaker, Aug. 25, 2005, Amphenol Corporation 2006, pp. 1-13, Jul. 25, 2004.

* cited by examiner

RETENTION MEMBER

CROSS-REFERENCE TO RELATED APPLICATIONS

This application is related by subject matter to U.S. patent application Ser. No. 11/726,936 filed Jun. 19, 2008.

BACKGROUND

An electrical connector may include a connector housing and a plurality of leadrame assemblies positioned in the connector housing. Such an electrical connector may include a retention member for stabilizing and securing the leadframe assemblies within the connector housing. For example, it may be necessary to keep the leadframe assemblies from moving in the x, y, and/or z directions.

There are a few different retention members that have been used to align the leadframe assemblies. One such retention member includes a right angle plate that connects to the top and back sides of each leadframe assembly. With the increased desire to miniaturize electrical connectors, however, attaching the right angle plate to the leadframe assemblies has been difficult, since the right angle plates must be miniaturized as well.

SUMMARY

An electrical connector having a retention member for aligning and stabilizing one or more leadframe assemblies of the electrical connector is provided. Such a connector may include a connector housing, a first leadframe assembly received in the connector housing, a second leadframe assembly received in the connector housing, and a retention member. The first and second leadframe assemblies may each include a leadframe housing and a plurality of electrically conductive contacts extending through the leadframe housing. Each leadframe housing may define a recess adapted to receive the retention member. The retention member may be received in the recesses. The retention member may include a first body portion having a first member extending from the body portion and a second member extending from the body portion, such that a face of the first member opposes a face of the second member. The first member may apply a first force against a first surface of each respective recess and the second member may apply a second force against a second surface of each respective recess. The first force may be in a first direction and the second force may be in a second direction opposite the first direction.

Each leadframe assembly may also include a shield and the retention member may be adapted to receive each shield. The retention member may be made of an electrically conductive material. Thus, the retention member may electrically connect the shields of the leadframe assemblies. In some embodiments each shield may include a first protrusion and a second protrusion. A first gap in the retention member may be adapted to receive the first protrusion, and a second gap in the retention member may be adapted to receive the second protrusion. Additionally, the retention member may include a first lead-in and a second lead-in. The first lead-in may be adapted to receive a distal end of the first protrusion, and the second lead-in may be adapted to receive a distal end of the second protrusion.

DETAILED DESCRIPTION OF ILLUSTRATIVE EMBODIMENTS

Figure 1:
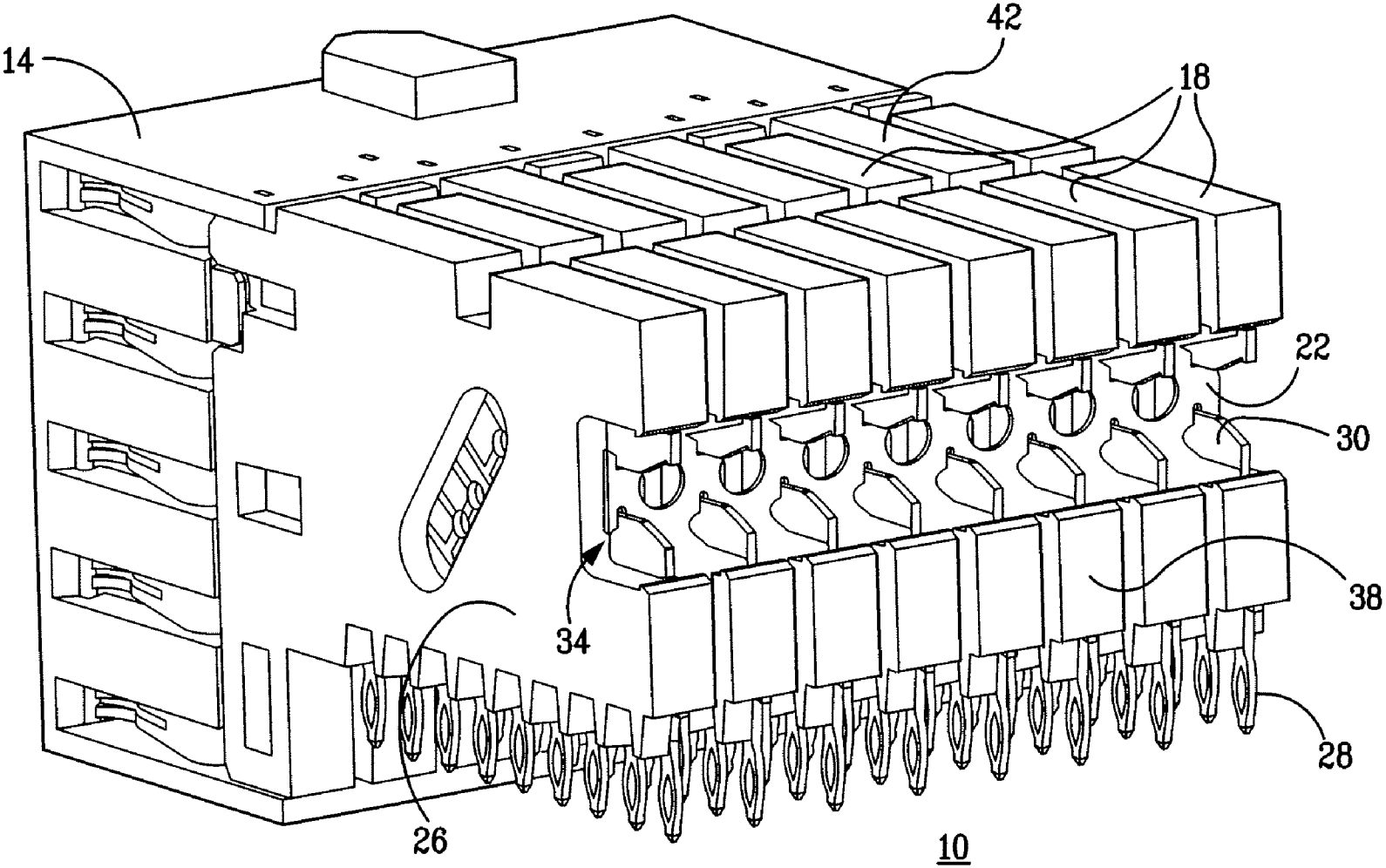
FIG. 1 is an isometric view depicting an example electrical connector.

FIG. 1 depicts an example embodiment of an electrical connector having a retention member to align and/or stabilize the leadframe assemblies of the connector in the x, y, and/or z directions. As shown, a connector 10 may include a connector housing 14, a plurality of leadframe assemblies 18 positioned in the connector housing 14, and a retention member 22 positioned in the leadframe assemblies 18. Each leadframe assembly 18 that is received in the connector housing 14 may include a respective leadframe housing 26, a plurality of electrically conductive contacts 28 extending through the leadframe housing 26, and a shield 30.

As shown in FIG. 1, each leadframe assembly 18 may include a recess 34 for receiving the retention member 22. As shown, the recesses 34 may be formed in a back side 38 of the leadframe assemblies 18. However, the recesses 34 may also be formed in a top side 42 of the leadframe assemblies 18.

Figure 2:
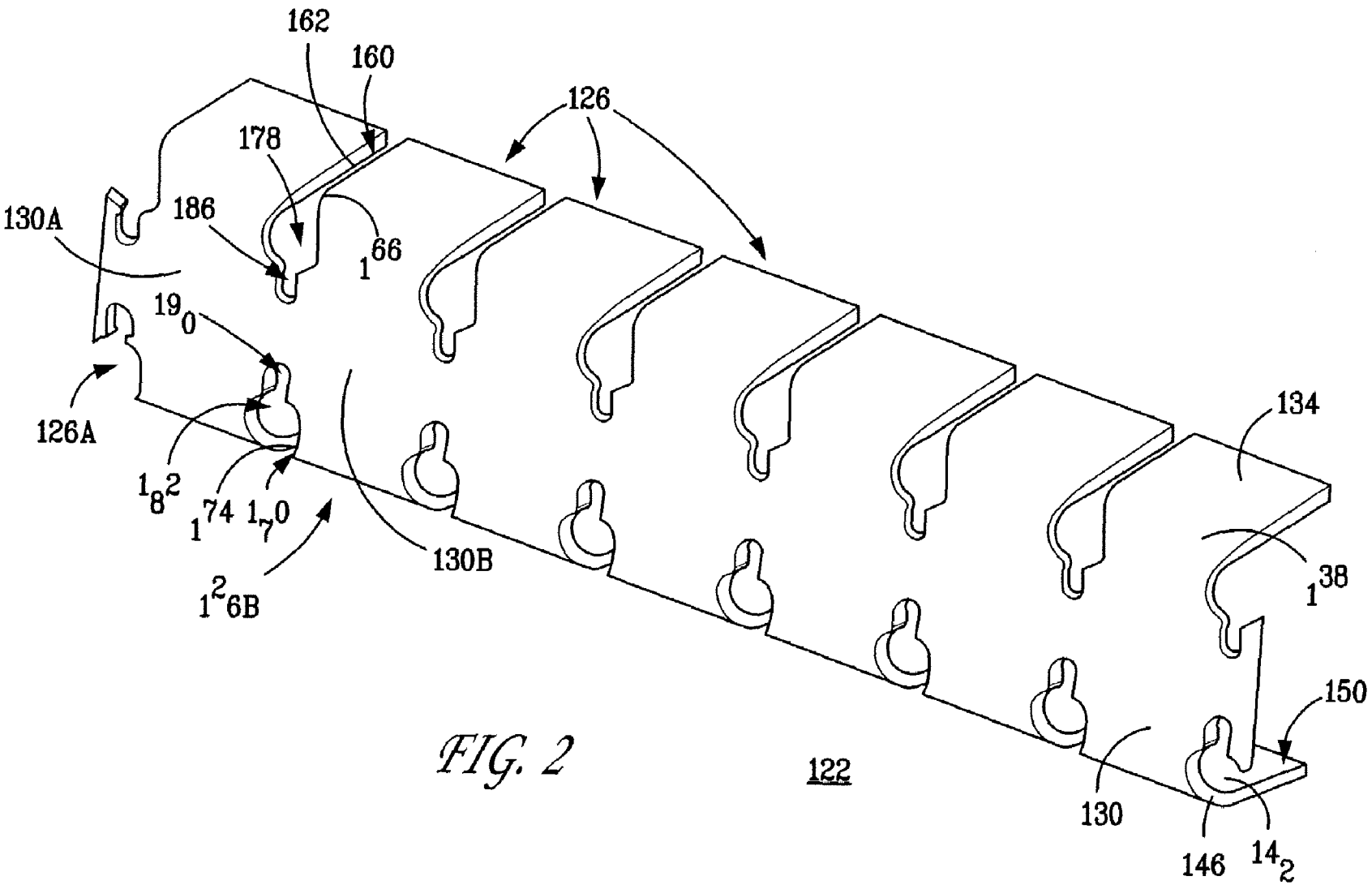
FIG. 2 is an isometric view depicting an example retention member.

FIG. 2 depicts an example embodiment of a retention member. As shown, a retention member 122 may include a plurality of member portions 126. The retention member 122 may be manufactured using methods well known in the art. For example, the retention member 122 may be continuously stamped from a sheet of electrically-conductive material and then trimmed to a desired length. The retention member 122 may be made from a variety materials. For example, the retention member 122 may be made of a durable material such as plastic. The retention member 122 may also be made of an electrically-conductive material, such as metal for example. In such embodiments, the retention member 122 may be adapted to electrically connect the shields of the leadframe assemblies.

As shown in FIG. 2, each member portion 126 may include a body portion 130, a first flexible member 134 extending from a first end 138 of the body portion 130, and a second flexible member 142 extending from a second end 146 of the body portion 130. The first and second flexible members 134 and 142 may extend such that a face (not shown) of the first flexible member 134 opposes a face 150 of the second flexible member 142. For example, the first and second flexible members 134 and 142 may be perpendicular to the body portion 130 and/or the first and second flexible members 134 and 142 may each extend at a respective angle from the body portion 130.

The member portions 126 may be arranged such that a first member portion 126A extends from a second member portion 126B and so on. As shown in FIG. 2, for example, the body portion 130B of the second member portion 126B may extend from the body portion 130A of the first member portion 126A. As shown, a first gap 160 may be defined between an edge 162 of the first flexible member 134 of the first member portion 126A and an adjacent edge 166 of the first flexible member 134 of the second member portion 126B. Similarly, a second gap 170 may be defined between an edge 174 of the second flexible member 142 of the first member portion 126A and an adjacent edge (not shown) of the second flexible member 142 of the second member portion 126B. The first and second gaps 160 and 170 may be adapted to receive a structure. For example, the first and second gaps 160 and 170 may be adapted to receive a shield or a protrusion extending from the leadframe housing.

As shown, each gap 160 and 170 may also include a lead-in to help with the insertion of the retention member 122 into the recess of the leadframe assemblies. For example, the first gap 160 may have a first lead-in 178 and the second gap 170 may have a second lead-in 182. Each lead-in 178 and 182 may be slightly wider than its respective gap 160 and 170. Because the lead-ins 178 and 182 are slightly wider than their respective gaps 160 and 170, it may be easier to guide a respective protrusion such as a shield into the gaps 160 and 170 by first inserting the protrusion into the wider lead-ins 178 and 182.

As shown, each lead-in 178 and 182 may include a contact groove. For example, the first lead-in 178 may have a first contact groove 186 and the second lead-in 182 may have a second contact groove 190. The first and second contact grooves 186 and 190 may each have a width that is similar to the width of the first and second gaps 160 and 170. If the retention member 122 is made of an electrically-conductive material, the first and second contact grooves 186 and 190 may help with the electrical connection between the shields of the leadframe assemblies. While the contact grooves 186 and 190 are shown as extending below the lead-ins 178 and above the lead-ins 182 respectively, it should be appreciated that the contact grooves 186 and 190 are not limited to such an embodiment. For example, the contact grooves 186 and 190 may extend in different directions from their respective lead-ins 178 and 182. Furthermore, the contact grooves 186 and 190 are not limited to a width that is similar to the width of the gaps 160 and 170. For example, the contact grooves 186 and 190 may be more narrow or wider than their respective gaps 160 and 170.

Figure 3:
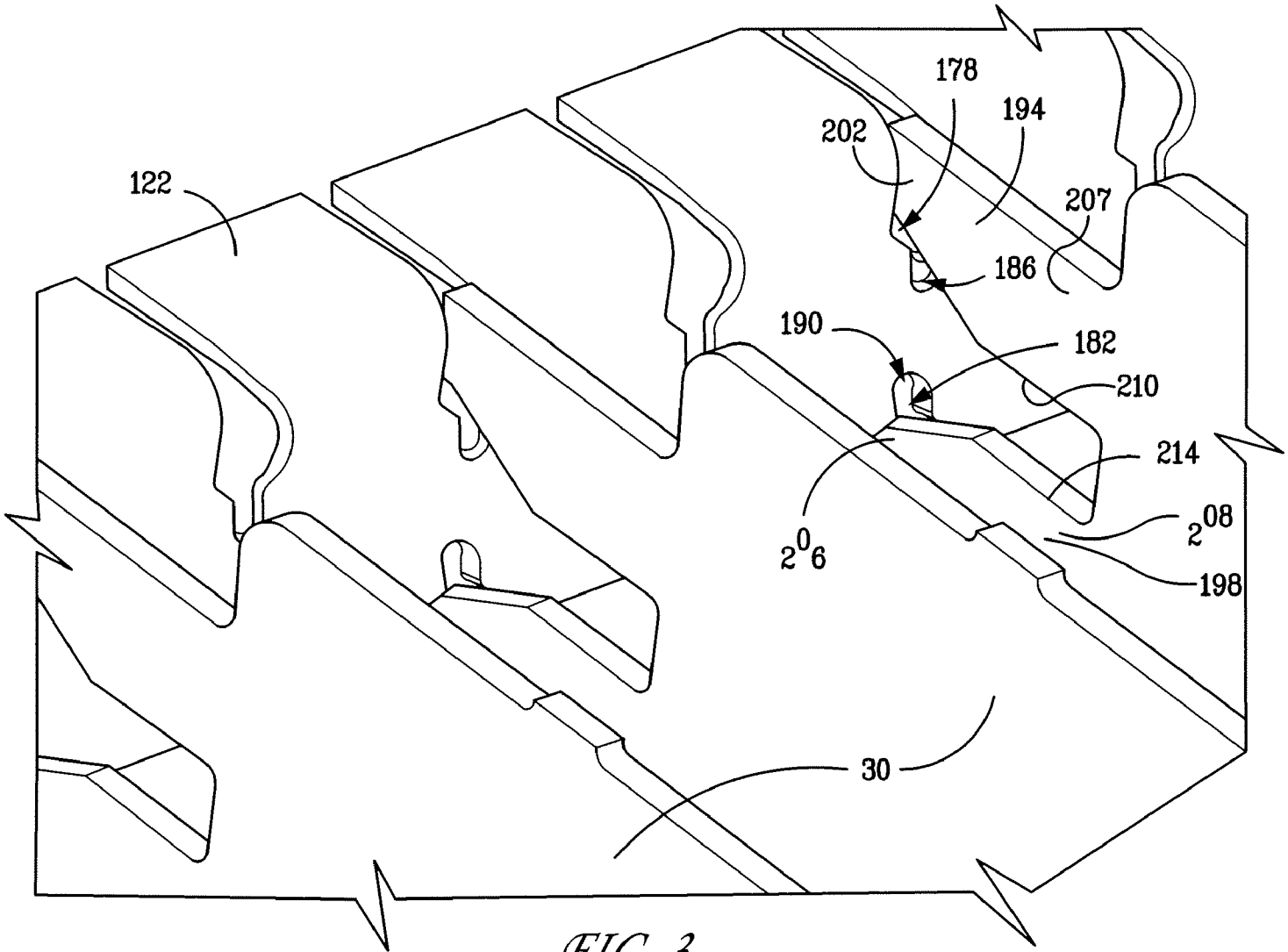
FIG. 3 depicts example shields engaging a portion of the retention member of FIG. 2.

The shields 30 may held reduce cross-talk between the contacts. FIG. 3 depicts the shields 30 being received by the retention member 122 (of the leadframe assemblies shown, the leadframe housings and contacts are not shown for clarity). Each shield 30 may be made of an electrically-conductive material, such as metal for example. Each shield 30 may extend through a respective leadframe housing. As shown, each shield 30 may include a first protrusion 194 and a second protrusion 198. Each first lead-in 178 of the retention member 122 may be adapted to receive a distal end 202 of a respective first protrusion 194. Similarly, each second lead-in 182 of the retention member 122 may be adapted to receive a distal end 206 of a respective second protrusion 198. As shown, the distal ends 202 and 206 may be more narrow than respective bases 207 and 208 of the protrusions 194 and 198 to help with insertion of the shields 30 into the retention member 122. When the first protrusions 194 are fully inserted into the retention member 122, a bottom portion 210 of each first protrusion 194 may be in contact with a respective first contact groove 186. Similarly, when the second protrusions 198 are fully inserted into the retention member 122, a top portion 214 of each second protrusion 198 may be in contact with a respective second contact groove 190.

Figure 4A:
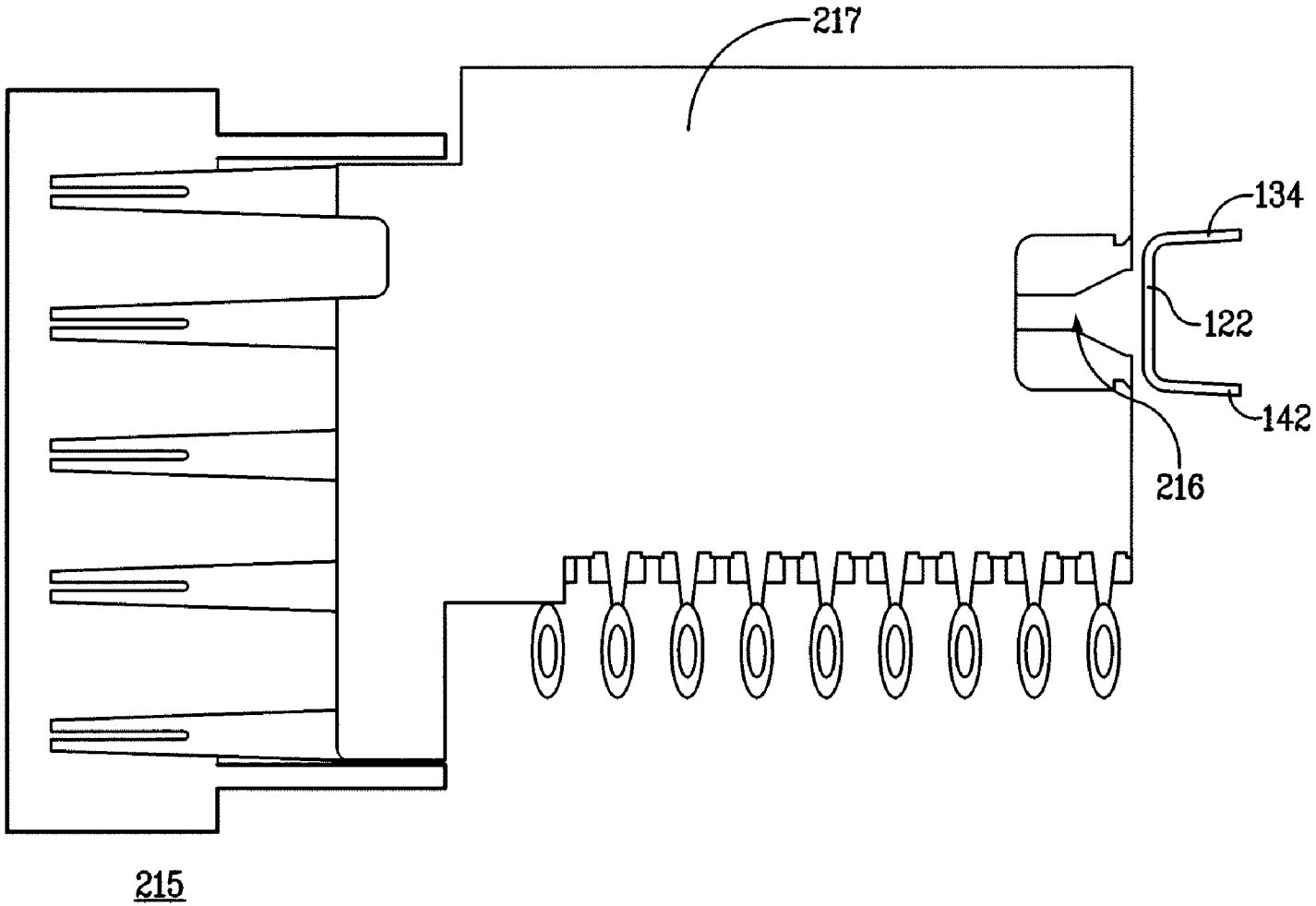
FIGS. 4A-4C are side views depicting a retention member being inserted into a connector.
Figure 4B:
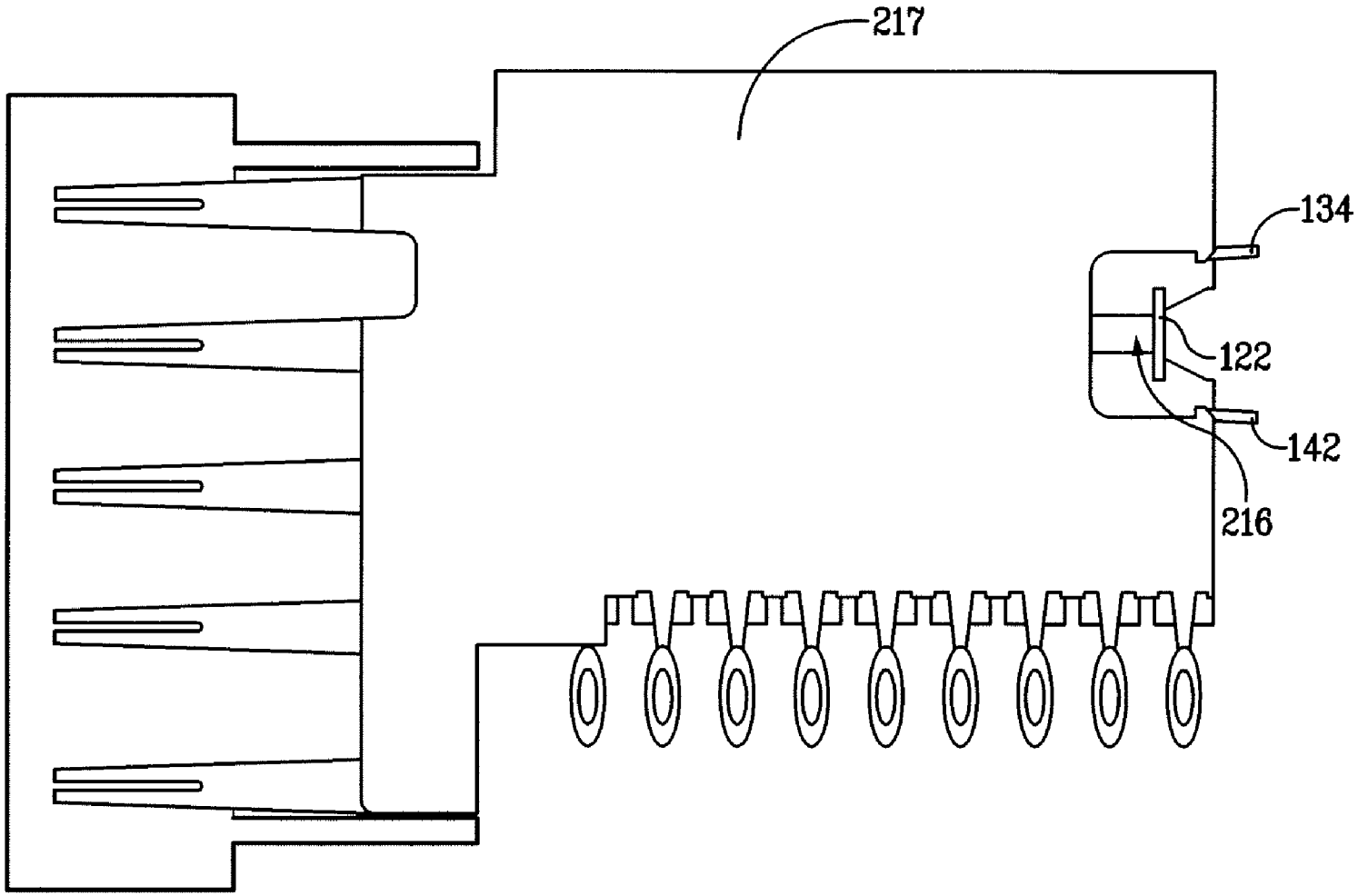
Figure 4C:
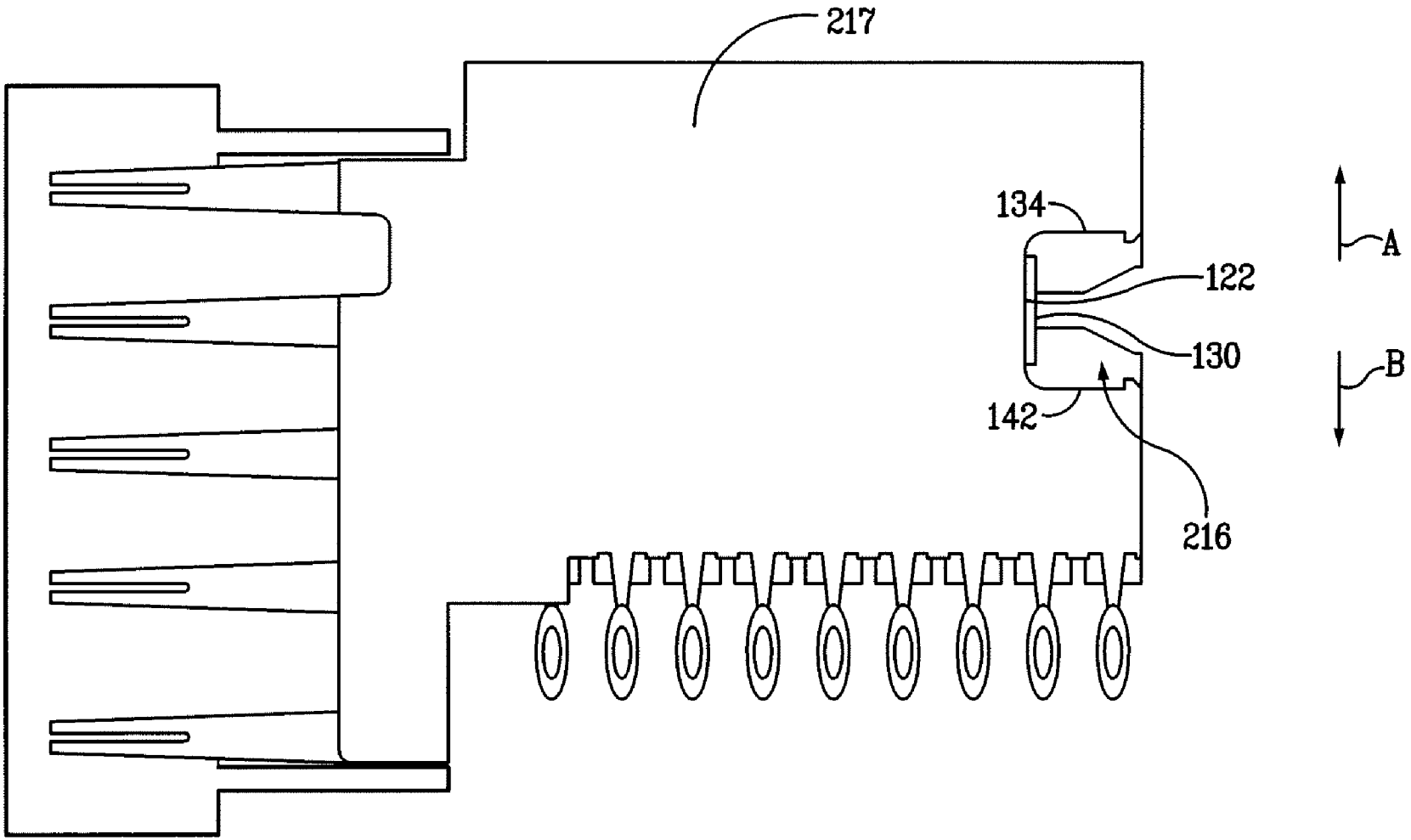

FIGS. 4A-4C depict the retention member 122 being inserted into an example connector 215. As shown in FIG. 4A, the first flexible member 134 of the retention member 122 may be angled in an upward direction and the second flexible member 142 of the retention member 122 may be angled in a downward direction prior to insertion into the connector 215. As shown in FIG. 4B, as the retention member 122 is being inserted into the recesses 216 of the leadframe assemblies 217, the first flexible member 134 may flex downward and the second flexible member 142 may flex upward toward each other. FIG. 4C depicts the retention member 122 fully inserted into the recesses 216 of the leadframe assemblies 217. When the retention member 122 is fully inserted, the first and second members 134 and 142 may each apply a force against respective surfaces of the recesses 216 of the leadframe assemblies 217. As shown in FIG. 4C, the first flexible members 134 may each apply a first force A against an upper surface (not shown) of respective recesses 216 of the leadframe assemblies 217 and the second flexible member 142 may apply a second force B against a bottom surface (not shown) of respective recesses 216 of the leadframe assemblies 217. The first and second forces A and B may be greater than respective normal forces acting on the members 134 and 142. When the retention member 122 has been fully inserted the members 134 and 142 may remain flexed or deformed. Additionally, when the retention member 122 has been fully inserted, the body portion 130 of the retention member 122 may abut a back surface (not shown) of the recesses 216.

It should be noted that prior to insertion, the retention member 122 may be flexible, but once it has been inserted into the recesses 216 of the leadframe assemblies 217, the retention member 122 may become more rigid.

Figure 5:
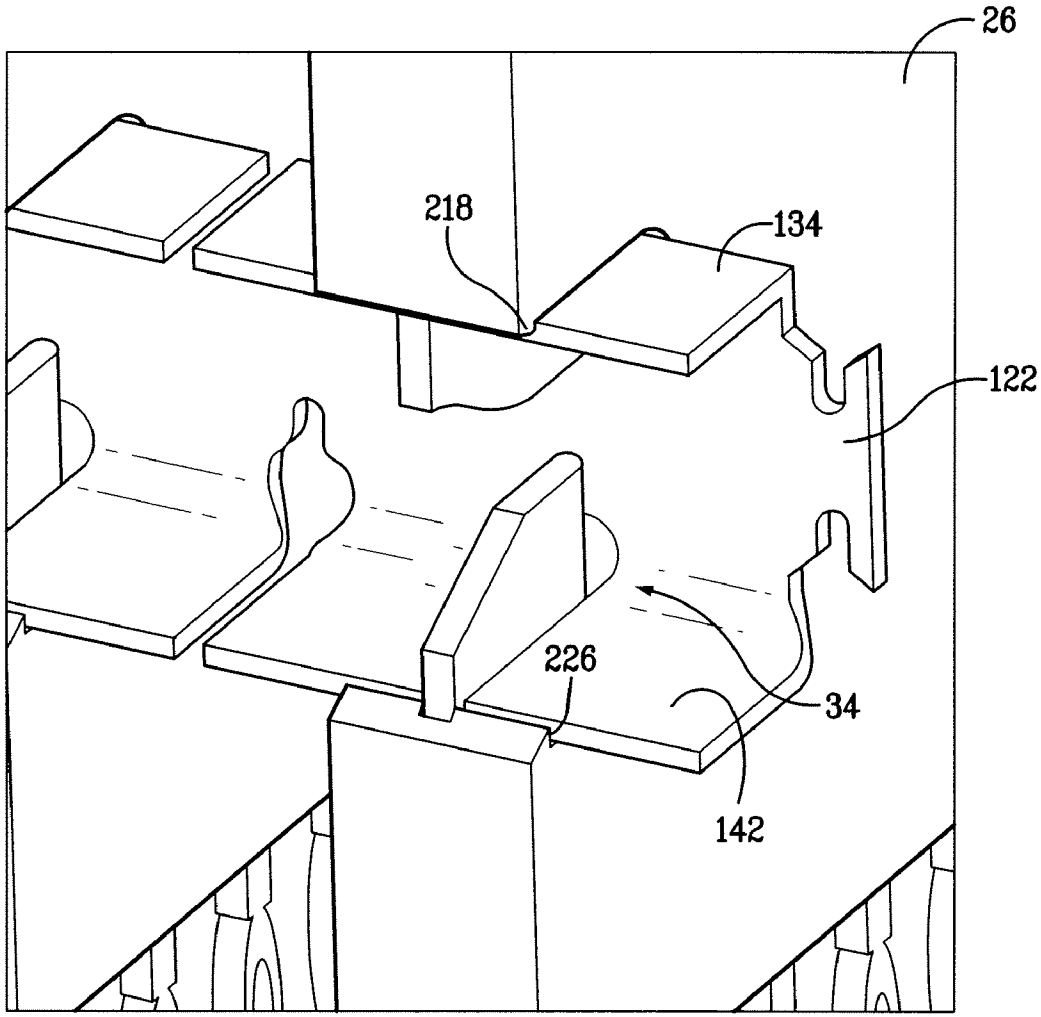
FIG. 5 depicts the retention member of FIG. 2 fully inserted into an a leadframe housing.

Additionally, once the retention member has been fully inserted, the leadframe housings 26 may be adapted to lock the retention member 122 in place. For example, FIG. 5 depicts a portion of the retention member 122 fully inserted and locked into one of the leadframe housings 26. As shown, each recess 34 may include a top surface (not shown), a back surface (not shown), and a bottom surface (not shown). Additionally, each recess 34 may include a first protrusion 218 extending downward from an end of a respective top surface, and a second protrusion 226 extending upward from an end of a respective bottom surface. Thus, when the retention member 122 is fully inserted into the recesses 34 of the leadframe housings 26, each of the first flexible members 134 may abut respective first protrusions 218 and each of the second flexible members 142 may abut respective second protrusions 226.

Figure 6:
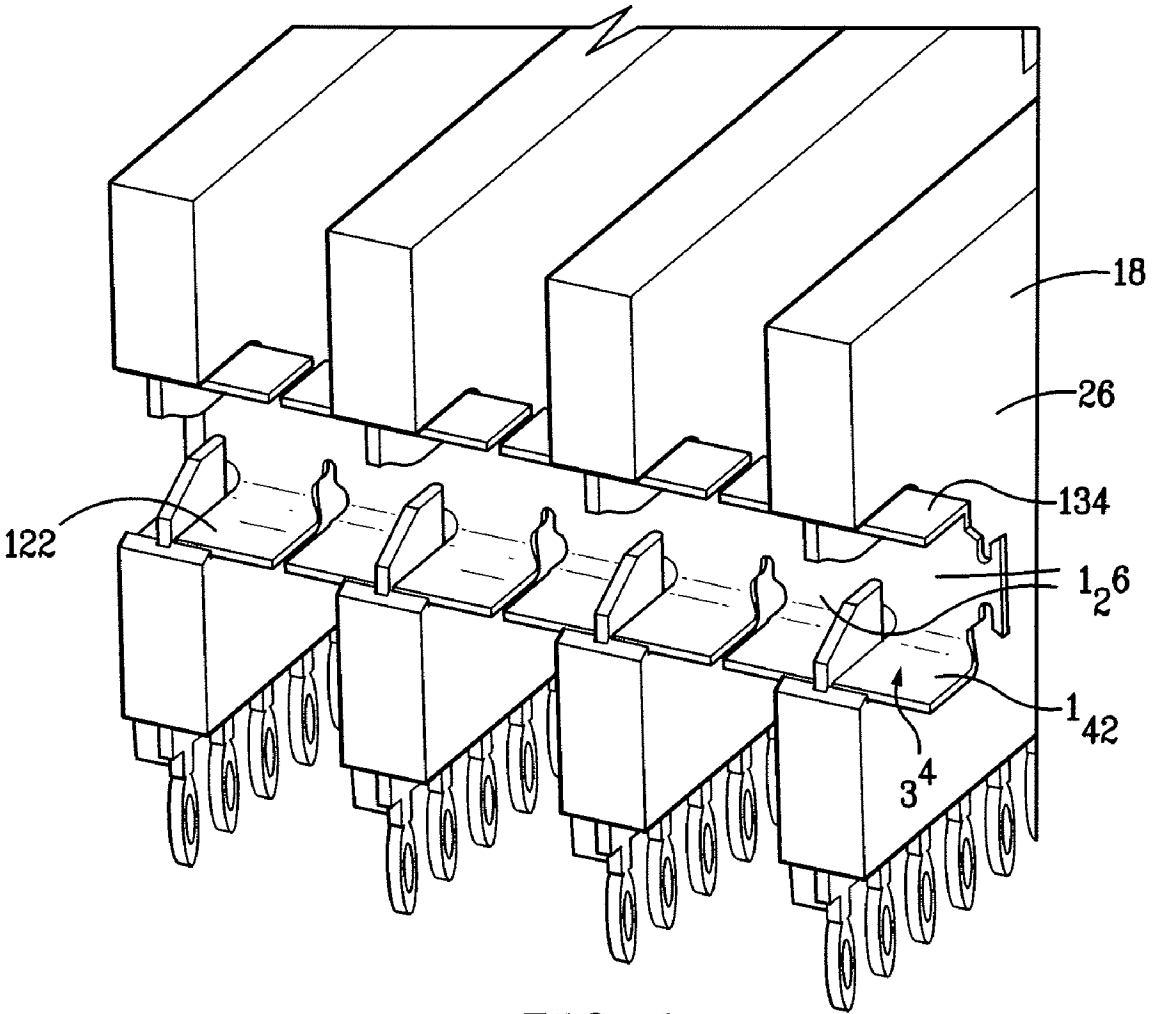
FIG. 6 is a partial isometric view depicting the retention member of FIG. 2 engaging a connector with every other leadframe shown.

FIG. 6 illustrates an example relationship between the retention member 122 and two adjacent leadframe assemblies 18. To help explain the relationship, FIG. 6 depicts a connector with every other leadframe assembly 18 shown. As shown, the retention member 122 may be adapted to have two leadframe housings 26 abut each member portion 126 of the retention member 122. In other words, each flexible member 134 and 142 of the retention member 122 may abut the top and bottom surfaces respectively of the recesses 34 of the leadframe housings 26 of two adjacent leadframe assemblies 18. By having each member portion 126 span across two leadframe assemblies 18, additional rigidity or stability may be provided.

What is claimed is:

1. An electrical connector comprising:

a connector housing supporting a plurality of conductive members;

a plurality of leadframe assemblies received in the connector housing in a vertical orientation; and a retention member comprising a plurality of adjacent member portions, wherein each member portion includes a first body portion, a first member extending from the first body portion and a second member extending from the first body portion such that a face of the first member opposes a face of the second member, and the first members of adjacent member portions define a first plurality of gaps, and the second members of adjacent member portions define a second plurality of gaps in vertical alignment with the first plurality of gaps;

wherein (i) the first leadframe housing defines a first recess and the second leadframe housing defines a second recess, (ii) the retention member is disposed in the first and second recesses such that the plurality of gaps receive the plurality of conductive members, respectively, so as to place the conductive members in electrical communication with each other, and (iii) the first member of the retention member applies a first force against a first surface of the first recess and against a first surface of the second recess.

2. The electrical connector of claim 1, wherein (i) the second member of the retention member applies a second force against a second surface of the first recess and against a second surface of the second recess, and (ii) the first force is in a first direction and the second force is in a second direction opposite the first direction.

3. The electrical connector of claim 1, wherein the first recess is formed in a back side of the first leadframe housing.

4. The electrical connector of claim 1, wherein (i) the first and second members of the retention member have an initial position before the retention member is received in the first and second recesses, and (ii) the first and second members have a second position that is different from the initial position after the retention member is received by the first and second recesses.

5. The electrical connector of claim 1, wherein the first leadframe assembly further comprises a shield, and the retention member is adapted to receive the shield.

6. The electrical connector of claim 1, wherein the retention member is adapted to stabilize the first leadframe assembly in the x, y, and z directions with respect to the second leadframe assembly.

7. The electrical connector of claim 1, wherein (i) the retention member further comprises a second body portion extending from the first body portion, the second body portion having a third member extending from the second body portion and a fourth member extending from the second body portion such that a face of the third member opposes a face of the fourth member, (ii) a first gap is defined between an edge of the first member and an adjacent edge of the third member, (iii) a second gap is defined between an edge of the second member and an adjacent edge of the fourth member, and (iv) the first and second gaps are adapted to receive a shield.

8. The electrical connector of claim 7, wherein (i) the shield comprises a first protrusion and a second protrusion, (ii) the first gap is adapted to receive the first protrusion, and (iii) the second gap is adapted to receive the second protrusion.

9. The electrical connector of claim 8, wherein (i) the retention member further comprises a first lead-in and a second lead-in, and (ii) the first lead-in is adapted to receive a distal end of the first protrusion, and the second lead-in is adapted to receive a distal end of the second protrusion.

10. The electrical connector of claim 1, wherein (i) the first recess includes a top surface, a back surface, and a bottom surface, and (ii) a first protrusion extends in a first direction from the top surface, and a second protrusion extends in a second direction from the bottom surface.

11. The electrical connector of claim 1, wherein the recess defines a top surface, a back surface, and a bottom surface, and the first body portion defines a first surface and an opposing second surface such that the first and second members extend from the first surface, and the second surface of the body portion abuts the back surface of the recess.

12. A retention member for an electrical connector, the retention member comprising:

a first body portion having a first member extending from the first body portion and a second member extending from the first body portion, such that the first member is disposed vertically above the second member; and a second body portion spaced horizontally from the first body portion, the second body portion having a third member extending from the second body portion and a fourth member extending from the second body portion, such that the third member is disposed vertically above the fourth member;

wherein (i) the second body portion extends from the first body portion, and the first and second body portions are each configured to be received in a recess defined by the electrical connector, (ii) a first gap is formed between a side of the first member and an adjacent side of the third member, (iii) a second gap is formed between a side of the second member and an adjacent side of the fourth member, wherein the first and second gaps are vertically aligned, (iv) the first and second gaps are each adapted to receive one of a plurality of shields of the electrical connector, the shields each having a protrusion, and (v) the retention member further comprises a first lead-in that is adapted to receive the protrusion.

13. The retention member of claim 12, further comprising a second lead-in, wherein (i) the shield comprises a second protrusion, and (ii) the second lead-in is adapted to receive the second protrusion.

14. The retention member of claim 12, wherein the retention member is made of an electrically conductive material.

15. The retention member of claim 12, wherein the retention member is adapted to electrically connect multiple shields.

16. The retention member as recited in claim 12, wherein the first and second body portions are configured to be received in a recess having a top surface, a back surface, and a bottom surface, and the first and second body portions each define a first surface and an opposing second surface, such that the first, second, third, and fourth members extend from the first surface, and the second surface is configured to abut the back surface of the recess when the retention member is installed in the electrical connector.

17. The retention member of claim 12, wherein the faces of the first and third members are horizontally spaced from each other, and the received shield is disposed between the faces of the first and third members.

18. An electrical connector comprising:

a connector housing;

a first leadframe assembly received in the connector housing, the first leadframe assembly comprising a leadframe housing, and a plurality of electrically conductive contacts extending therethrough; and a retention member comprising a body portion, a first member and a second member each extending from the body portion in a direction away from the leadframe assembly such that the first member is vertically spaced from the second member so as to define a first gap disposed therebetween, and a third member and a fourth member extending from the body portion in a direction away from the leadframe assembly such that the third member is vertically spaced form the fourth member so as to define a second gap disposed therebetween, wherein a third gap is formed between a side of the first member and an adjacent side of the third member, a fourth gap is formed between a side of the second member and an adjacent side of the fourth member, and each of the first, second, third, and fourth members defines an inner surface facing one of the first and second gaps and an opposing outer surface facing away from the one of the first and second gaps;

wherein the leadframe housing defines a recess, and the retention member is received in the recess such that the outer surfaces are biased against the leadframe housing.

19. The electrical connector of claim 18 further comprising a second leadframe assembly adjacent the first leadframe assembly, wherein the retention member is adapted to align the first leadframe assembly in the x, y, and z directions with respect to the second leadframe assembly.

20. The electrical connector of claim 18, wherein the recess is formed in a back side of the leadframe housing.

21. The electrical connector of claim 18, further comprising a second leadframe assembly received in the connector housing, the second leadframe assembly comprising a leadframe housing, and a plurality of electrically conductive contacts extending therethrough, wherein the first and second leadframe assemblies each includes a respective shield and the retention member electrically connects the respective shields to each other.

22. The electrical connector of claim 18, wherein the first and second members extend in the same direction from the first surface.

23. The electrical connector of claim 18, wherein the recess defines a top surface, a bottom surface, and a back surface connected between the top and bottom surfaces, and the outer surface of the retention member is biased against at least one of the top and bottom surfaces of the recess.

24. An electrical connector comprising:

a connector housing;

a first leadframe assembly received in the connector housing, the first leadframe assembly comprising a leadframe housing, and a plurality of electrically conductive contacts extending therethrough;

a second leadframe assembly received in the connector housing, the second leadframe assembly comprising a leadframe housing, and a plurality of electrically conductive contacts extending therethrough; and a retention member including a first body portion and a second body portion disposed adjacent the first body portion, each body portion including a first and second member extending in a common direction therefrom such that a face of the first member opposes a face of the second member, wherein a first gap is defined between the first members and a second gap is defined between the second members and is vertically spaced from the first gap, and the gaps receive a conductive member so as to place the conductive member in electrical communication with the retention member.

25. The electrical connector of claim 24, further comprising a plurality of electrical shields, wherein the retention member comprises a plurality of body portions defining gaps therebetween, wherein each gap receives one of the plurality of electrical shields so as to place the electrical shields in electrical communication with each other.

26. The electrical connector of claim 24, wherein (i) at least one of the first and second body portions defines a first surface and an opposing second surface, and the first and second members extend from the first surface, (ii) at least on of the leadframe housings defines a recess, (iii) the recess defines a top surface, a back surface, and a bottom surface, and (iv) the retention member is received in the recess such that the second surface of the retention member abuts the back surface of the recess.

27. The electrical connector of claim 24, wherein the conductive member is a shield, and the first and second gaps receive the shield.

* * * * *